United States Patent [19]

Mathieu

[11] Patent Number: 4,693,367

[45] Date of Patent: Sep. 15, 1987

[54] SHIPPING BOX FOR CLOTHING WITH ARTICLE POSITIONING MEANS

[75] Inventor: Andre Mathieu, St-Hilaire, Canada

[73] Assignee: Dorfin Paper Products (Quebec) Limited, Montreal, Canada

[21] Appl. No.: 909,627

[22] Filed: Sep. 22, 1986

[30] Foreign Application Priority Data

Sep. 16, 1986 [CA] Canada ..... 518281

[51] Int. Cl.[4] ..... B65D 85/18; B65D 25/10

[52] U.S. Cl. ..... 206/289; 206/279; 206/284; 206/288; 206/292; 206/299

[58] Field of Search ..... 206/278, 279, 284, 288, 206/289, 292, 295, 299, 495, 476

[56] References Cited

U.S. PATENT DOCUMENTS

| | | | |
|---|---|---|---|
| 1,094,087 | 4/1914 | O'Donnell | 206/284 |
| 1,448,629 | 3/1923 | Lang | 206/216 |
| 1,961,742 | 6/1934 | Dukes | 206/279 |
| 2,508,579 | 5/1950 | McFall | 206/292 |
| 2,543,275 | 2/1951 | Berman | 206/284 |
| 2,779,460 | 1/1957 | Fish | 206/208 |
| 4,014,436 | 3/1977 | Tunis | 206/299 |

*Primary Examiner*—Stephen Marcus
*Assistant Examiner*—Brenda J. Ehrhardt
*Attorney, Agent, or Firm*—Charles E. Brown; Charles A. Brown

[57] ABSTRACT

A corrugated shipping box comprises a tray and a lid and a panel hinged to the lid and foldable within the enclosure formed by the tray and the lid. The panel has a sub-panel extending rearwardly of the rear face thereof and an aperture in the front face for receiving a garment hanger. A garment can be folded over the panel by first inserting the garment hanger in the aperture passing the garment around the free edge of the panel over the back face and through a slot provided in the sub-panel to thereby retain the garment in a draped position and prevent bunching thereof in the box.

5 Claims, 5 Drawing Figures

SHIPPING BOX FOR CLOTHING WITH ARTICLE POSITIONING MEANS

BACKGROUND OF THE INVENTION

1. Field of the Invention

The present invention relates to a shipping container box, and more particularly to a paperboard shipping box for garments.

2. Description of the Prior Art

Paperboard boxes, particularly corrugated paperboard flat boxes, are conventionally used by mail-order houses for shipping garments such as ladies' dresses. Such boxes normally include a shallow tray portion with a hinged lid. The tray and lid have narrow side and end walls which are adapted to be interlocked for shipping. The box can then be shipped in the post without further wrapping. The address of the sendee is written directly on the box. When the sendee receives the box, the contents, such as a dress, may be crumpled because it has shifted within the box during transit. Even if a stiffener is provided within the box with the dress wrapped around, there is still nothing to stop the dress from shifting especially if it is made of a very delicate or flimsy material. The appearance of such a garment on receipt by the mail-order customer is very important. A large percentage of mail-order returns is statistically due to the customer not liking a garment on first sight when the garment has been received in a crumpled condition.

SUMMARY OF THE INVENTION

It is an aim of the present invention to provide a shipping box which will overcome the problems mentioned above, by providing a one-piece shipping box having a tray, lid, and intermediate panel on which the garment can be hung and supported.

A construction in accordance with the present invention includes a shipping box comprising a tray defined by a first panel, and side and front end walls extending at right angles to the edges of the first panel. A hinge panel extends along the rear edge of the first panel, and a lid is connected to the hinge panel and includes a second panel, and side walls and a front wall extending from the edges of the second panel. The improvement comprises a third panel insertable within the tray and including a front face and a rear face, a head portion and bottom edge. A sub-panel extends from the rear face and defines a slot extending transversely relative to the third panel. Garment hanger receiving means are provided on the head portion of the third panel. The third panel and sub-panel are such that a garment can be hung by way of a garment hanger on the front face of the third panel such that the garment can fold over the rear face of the third panel over the bottom edge and the end thereof passed through the slot in the sub-panel to hang from the sub-panel.

More specifically, the sub-panel may be one piece with the third panel and is cut out and hinged to the third panel along an edge of the sub-panel.

In a more specific embodiment of the present invention, the third panel is integral with and hinged to the front wall of the lid.

A blank in accordance with the present invention comprises a first rectangular panel with side flaps adapted to form side walls extending along the longitudinal side edges of the first panel and at least an end flap extending along on a lateral edge adapted to form an end wall. A hinge panel is provided along the other lateral edge, and a second panel similar to the first panel is hinged to the hinge panel. The second panel includes side flaps adapted to form side walls extending along the side edges of the second panel. A third rectangular panel is hinged to the remaining lateral edge of the second panel. The third panel has longitudinal side edges and a lateral end edge. A first fold line is provided in the third panel, parallel and spaced from the remaining lateral edge of the second panel, and terminates at each respective end in score lines which extend to the respective side edges of the third panel. A further score line extends parallel, spaced from, and coextensive with the first fold line and merges with a respective short longitudinal score line at each end thereof which terminates in a lateral fold line extending to each respective side edge. A still further score line extends parallel to and spaced from the further score line and merges at each end in longitudinally extending short score lines, each of which terminates intermediate the latter fold lines. The area between the further score line and the still further score line defines a sub-panel hinged to the third panel.

Thus, a one-piece blank can be assembled into a shipping box for mailing a garment such as a dress, whereby the dress can be placed on a hanger and hung to the front face of the third panel. It can be draped around the bottom edge, and the end can be passed over the sub-panel which can be closed against the third panel to lock and hold the dress in place and under a slight tension.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figures 1, 2, 3:
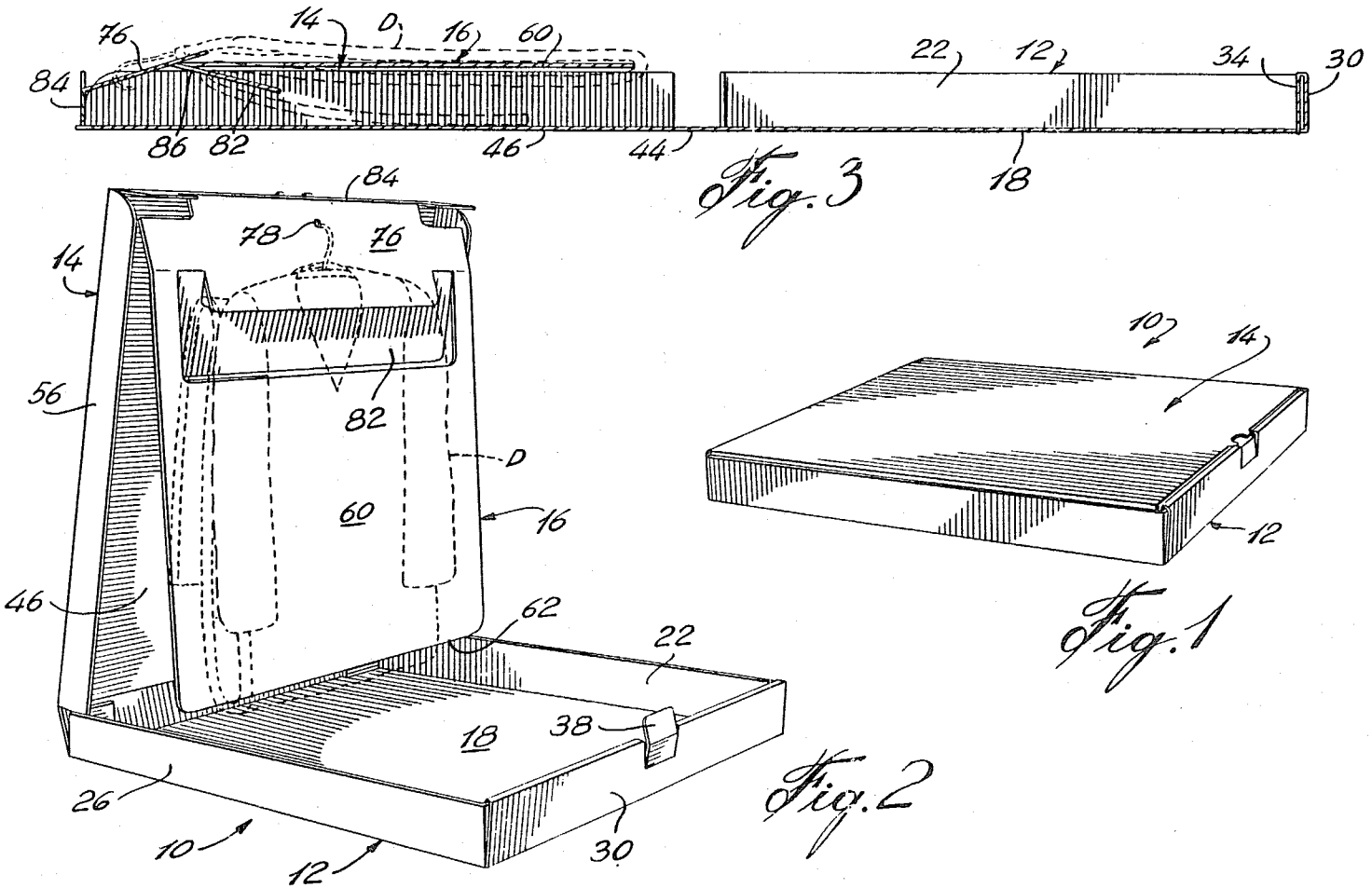
FIG. 1 is a perspective view of the closed garment shipping box.
FIG. 2 is a perspective view of the shipping box in an opened position.
FIG. 3 is a longitudinal cross-section of the shipping box shown in a fully open position.

Referring now to the drawings, the shipping box 10 is shown having a tray 12 and a lid 14. An intermediate panel 16 depends from the lid 14 and is constructed to support a garment, such as a dress D, illustrated in FIGS. 2 and 3.

Figure 5:
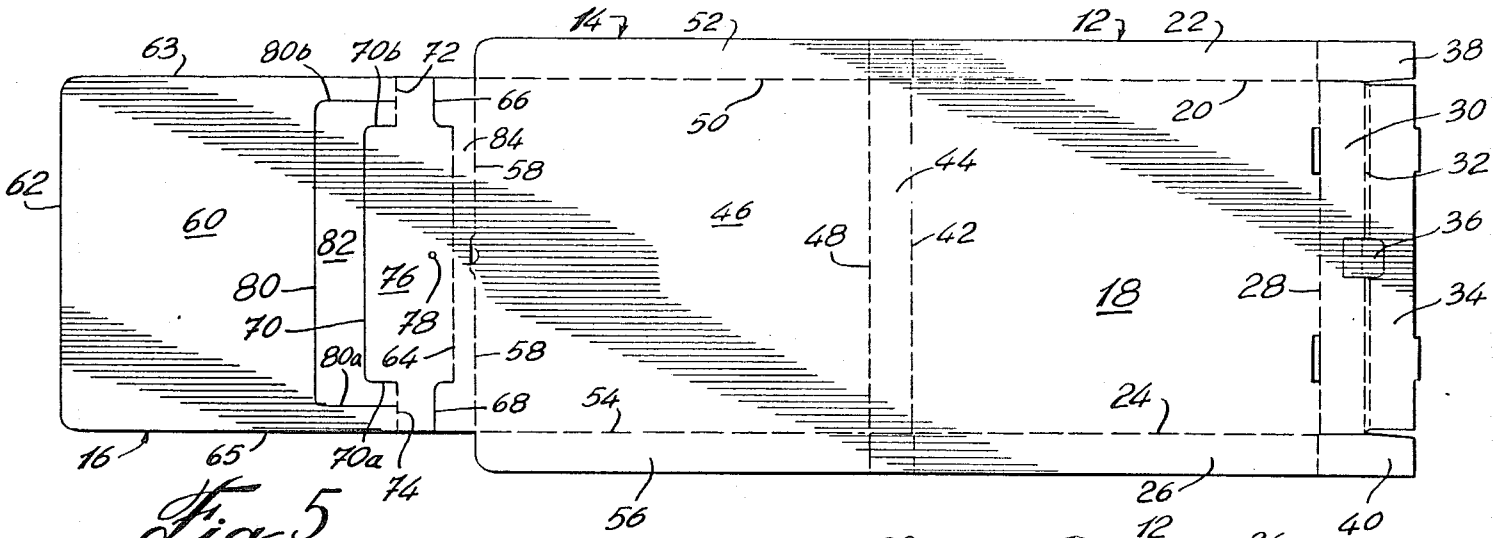
FIG. 5 is a top plan view of the blank prior to assembling the blank into the shipping box.
Figure 4:
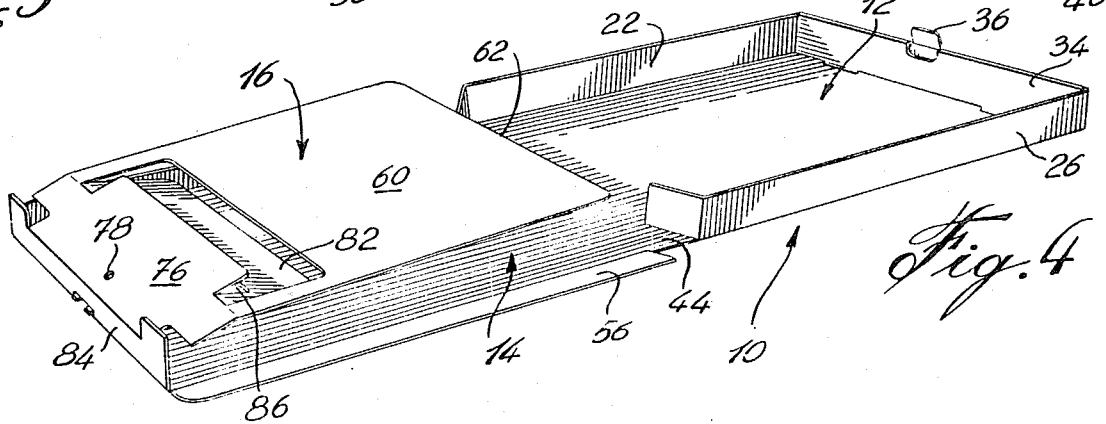
FIG. 4 is a perspective view of the shipping box in the position shown in FIG. 3.

Referring now to FIGS. 4 and 5, the box, which would be made of corrugated paperboard material, includes a first rectangular panel 18 having longitudinal edges 20 and 24 and lateral edges 28 and 42. Flaps 22 and 24 are foldable about the edges 20 and 24 to form upstanding side walls, as shown in FIG. 4. An end panel 30 folds about the end edge 28, and an end flap 34 folds about the fold line 32 onto the panel 30, as shown in FIG. 4, to form the end wall thereof. Corner flaps 38 and 40 are insertable between the panel 30 and flap 34 to retain the flaps 22 and 26 in an upright position forming the tray 12. A locking tab 36 is cut out from the panel 30 and flap 34 to cooperate with the lid 14.

An intermediate hinge panel 44 extends along the lateral edge 42 and is integral with a rectangular panel 46 of dimensions similar to the panel 18. The panel 46 includes a lateral edge 48 coincident with the fold line along the edge of the panel 44, and includes longitudinal edges 50 and 54 as well as lateral edge 58. Side flaps 52 and 56 fold about edges 50 and 54 respectively to form side walls of the lid 14.

Depending from the end edge 58 of the panel 46 is a rectangular panel 60 having a width similar to the width of the panel 46 and a length slightly shorter than the length of the panel 46 or 18. The panel 60 includes an end edge 62 and side edges 63 and 65.

The panel 60 is rectangular in shape and includes a fold line 64 parallel to the end edge 58. The fold line 64 terminates at each end in die-cut lines 66 and 68 which are slightly L-shaped, as shown in FIG. 5. The fold lines 64 and 58 define therebetween the end wall panel 84 of the lid 14, as shown in FIG. 4.

A die-cut line 70 is parallel to the fold line 64 and is spaced therefrom, as shown in FIG. 5, and the ends thereof are L-shaped at 70a and 70b. The ends of the die-cut lines 70a and 70b terminate in fold lines 72 and 74 which are parallel to the die-cut line 70. Thus, the flap 76 is formed between the die-cut line 70 and the fold line 64, as shown in FIG. 4.

A further die-cut line 80 is provided, spaced from the die-cut line 70, and is parallel therewith but slightly longer and terminates in L-shaped die-cut lines 80*a* and 80*b*. Lines 80*a* and 80*b* respectively terminate intermediate the fold lines 74 and 72. The die-cut lines 70 and 80 define therebetween the sub-panel 82 which folds back along fold lines 72 and 74 behind the rear face of the panel 16 and act as a hanger bar, as will be described later.

When it is necessary to utilize the shipping box 10 for shipping a garment, such as a dress, the tray 12 and lid 14 are assembled in the conventional manner and the panel 60 is allowed to fold inbetween the tray 12 and lid 14 providing an intermediate insert within the box. A dress D is hung on a conventional hanger, and the hook of the hanger is passed through an aperture 78 provided in the panel 76. The dress is allowed to hang down the front face of panel 60 and is draped about the bottom edge 62 along the rear face of the panel 60 with a small tension provided thereon, and the end of the dress is passed through the opening 86 formed between the panel 76 and the sub-panel 82, as shown in FIGS. 2 and 3. Once the end of the dress is passed through and draped over the hanger bar formed by the sub-panel 82, it is allowed to drape behind the sub-panel. The folding over of the dress in this manner will be sufficient to maintain the dress in a firm unshiftable position. The dress can be further secured by closing the sub-panel 82 back into its cutout in the panel 60, thereby locking the dress in position.

Once the dress has been fully draped over the various elements mentioned above, the lid 14 is closed onto the tray 12 with the intermediate panel 16 with the dress D thereon lying between the two.

I claim:

1. A shipping box comprising a tray defined by a first panel and side and front end walls, a hinge panel extending along the rear edge of the first panel, and a lid connected to the hinge panel and including a second panel, the second panel including depending side walls and a front wall extending from the edges thereof, the improvement comprising a third panel insertable within the tray and including a front face and a rear face, the panel having a head portion and a bottom edge, a sub-panel extending from the rear face and defining a slot extending transversely relative to the third panel, garment hanger receiving means provided on the head portion of the panel whereby a garment can be hung from a garment hanger and draped about the bottom edge of the third panel over the rear face of the third panel and further draped through the slot in the sub-panel to thereby hang from the sub-panel and be retained on the third panel in a firm position.

2. A shipping container as defined in claim 1, wherein the sub-panel is one piece with the third panel and is cut out therefrom and is thus hinged to the third panel.

3. A shipping container as defined in claim 1, wherein the third panel is integral and hinged to the front wall of the lid.

4. A shipping container as defined in claim 1, wherein the shipping box, including the tray, lid, and intermediate panel, are one piece and are made of corrugated paperboard material.

5. A blank for forming a shipping container comprising a first rectangular panel with side flaps adapted to form side walls extending along the longitudinal side edges of the first panel and at least an end flap extending along a lateral edge adapted to form an end wall, a hinge panel provided along the other lateral edge and a second panel similar to the first panel hinged to the hinge panel, the second panel including side flaps adapted to form side walls extending along the side edges of the second panel, and a third panel is hinged to the remaining lateral edge of the second panel, the third panel being rectangular with longitudinal side edges and a lateral end edge, a first fold line provided in the third panel parallel and spaced from the remaining lateral edge of the second panel and terminating at each end thereof in score lines which extend to the respective side edges of the third panel, a further score line extending parallel and spaced from the coextensive with the first fold line and the further score line merging with short longitudinally extending score lines at each end thereof which terminate in lateral fold lines extending to each respective side edge, a still further score line extending parallel to and spaced from the further score line which merges at each end in longitudinally extending short score lines, each of which terminates intermediate the latter fold lines, the area formed between the further score line and the still further score line adapted to define a sub-panel.

* * * * *